US006478294B2

(12) United States Patent
Hiratani

(10) Patent No.: US 6,478,294 B2
(45) Date of Patent: Nov. 12, 2002

(54) SHEET FEEDING DEVICE FOR RELIABLY SEPARATING STACKED SHEETS AND IMAGE FORMING APPARATUS USING SAME

(75) Inventor: Kenji Hiratani, Yokoyama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/826,906

(22) Filed: Apr. 6, 2001

(65) Prior Publication Data

US 2002/0003332 A1 Jan. 10, 2002

(30) Foreign Application Priority Data

Apr. 6, 2000 (JP) ..... 2000-104492
Mar. 1, 2001 (JP) ..... 2001-056186

(51) Int. Cl.[7] ..... B65H 5/00

(52) U.S. Cl. ..... 271/10.09; 271/121; 271/123; 271/127

(58) Field of Search ..... 271/10.09, 10.11, 271/118, 121, 123, 126, 127

(56) References Cited

U.S. PATENT DOCUMENTS 5,372,359 A * 12/1994 Miura et al. ..... 271/121
5,863,036 A * 1/1999 Tanaka et al. ..... 271/10.11
5,887,867 A * 3/1999 Takahashi et al. ..... 271/127
5,938,835 A * 8/1999 Suzuki ..... 271/121
5,951,003 A * 9/1999 Nojima et al. ..... 271/121
6,354,584 B1 * 3/2002 Suga et al. ..... 271/127

FOREIGN PATENT DOCUMENTS

JP 05170347 A 7/1993
JP 09202475 A 8/1997
JP 11011698 A 1/1999

OTHER PUBLICATIONS

Froula, Sheet Separator, Jun 1975, IBM Technical Disclosure Bulletin, vol. 18 No. 1, p. 48.*

* cited by examiner

*Primary Examiner*—H. Grant Skaggs
(74) *Attorney, Agent, or Firm*—Oblon, Spivak, McClelland, Maier & Neustadt, P.C.

(57) ABSTRACT

A sheet feeding device includes a feeding roller that is driven to rotate, and a base plate to stack sheets thereupon. The sheet feeding device is configured to rotate around a supporting axis thereof in directions to contact and separate from the feeding roller. A base plate pressing member is configured to press the base plate toward the feeding roller, such that an uppermost sheet of the stack of sheets stacked on the base plate contacts the feeding roller in order to be fed by the feeding roller. A first friction device is arranged in a vicinity of a first part of an upper surface of the base plate so as to oppose the feeding roller. The first friction device is configured to provide a bottom sheet of the stack of sheets stacked on the base plate with a first frictional resistance greater than a predetermined value. A second friction device is arranged upstream of the first friction device in a sheet feeding direction and is configured to provide the bottom sheet of the stack of sheets stacked on the base plate with a second frictional resistance greater than the predetermined value.

62 Claims, 4 Drawing Sheets

SHEET FEEDING DEVICE FOR RELIABLY SEPARATING STACKED SHEETS AND IMAGE FORMING APPARATUS USING SAME

CROSS-REFERENCE TO RELATED APPLICATIONS

This application is related to and claims priority, under 35 U.S.C. § 119, from Japanese Patent Application No. 2000-104492, filed on Apr. 6, 2000, and Japanese Patent Application No. 2001-056186 filed on Mar. 1, 2001, and the entire contents of both Japanese patent applications are hereby incorporated by reference herein.

BACKGROUND OF THE INVENTION

1. Field of the Invention

The present invention relates to a sheet feeding device having a base plate which is configured to be rotatable so that sheets, which are stacked on the base plate, are pressed against a feeding roller in order to be fed, and an image forming apparatus using the sheet feeding device.

2. Discussion of Background

Japanese Patent Laid-Open Publication No. 5-170347 discloses a sheet feeding device which feeds sheets stacked on a rotatable base plate with a feeding roller. Beginning with the uppermost sheet of the stacked sheets, the sheets are fed one by one by pressing the base plate toward the feeding roller so that the stack of sheets stacked on the base plate are pressed against and into contact with the feeding roller. As the number of sheets stacked on the base plate decreases, the base plate rotates toward the feeding roller such that an uppermost sheet, of the stack of sheets stacked on the base plate, is pressed against and into contact with the feeding roller.

It is known to provide a friction member on an upper surface of the base plate in the vicinity of a part of the base plate opposed to the feeding roller, i.e., at a part of a free end side of the base plate. This gives a frictional resistance to a bottom sheet of the stack of sheets stacked on the base plate. Thus, the bottom sheet, of the stack of sheets stacked on the base plate, is prevented from being pulled out from its position against the base plate when the uppermost sheet is fed.

The above-described sheet feeding device must be configured so that only the uppermost sheet is reliably pulled out from the stack of sheets stacked on the base plate. In other words, the uppermost sheet of the stack of sheets stacked on the base plate must slip relative to adjacent and subsequent sheets stacked on the base plate. Further, even when the number of sheets in the stack of sheets stacked on the base plate has been decreased such that the bottom sheet of the stack of sheets receives a gripping force from the feeding roller, the bottom sheet must be prevented from being pulled out from its position against the base plate via the frictional resistance of the friction member against the bottom sheet. Furthermore, the sheet feeding device must be configured such that when only one sheet, i.e., the last sheet of the stack of sheets, remains on the base plate, the feeding roller pulls out the last sheet using a pulling force which is larger than the frictional resistance which the friction member provides with respect to the last sheet of the stack of sheets stacked on the base plate.

The sheet feeding device includes a feeding roller which feeds out the uppermost sheet of the stack of sheets stacked on the base plate via a pulling force Fa of the feeding roller acting on the uppermost sheet. A frictional resistance Fb acts between each sheet of the stack of sheets stacked on the base plate. A friction member is located at a free end side of the base plate and provides a frictional resistance Fc to a bottom sheet of the stack of sheets stacked on the base plate. The sheet feeding device is configured so that the relationship Fa>Fc>Fb is satisfied.

However, even when a sheet feeding device is designed so as to satisfy the relationship Fa>Fc>Fb, sheets may still be double-fed (i.e., a plurality of sheets are pulled out at the same time from the stack of sheets stacked on the base plate). Of course, the occurrence of the double-feeding phenomenon in part depends upon the quality of the sheets, the environmental conditions (e.g., temperature and humidity), the state of static electricity, and the resilience of the sheets, etc. Therefore, for preventing such a double feeding of sheets, a separation device is generally arranged in the vicinity of an end of the base plate at the downstream side of the sheet feeding device in the sheet feeding direction so as to oppose the feeding roller. The relationship Fa>Fc>Fb is further desired to be satisfied such that the burden on the separation device is decreased and thereby the sheet separation performance is enhanced and each sheet of the stack of sheets stacked on the base plate are reliably fed from first sheet to last sheet.

Changes in the quality of the sheets, the environmental conditions, such as temperature and humidity, the state of the static electricity, and the resilience of the sheets affect the pulling force Fa, and the frictional resistances Fb and Fc.

Moreover, as the number of sheets of the stack of sheets stacked on the base plate increases, the base plate is positioned lower relative to the feeding roller so as to contract a base plate pressing member which upwardly biases the base plate. Thereby, the pulling force Fa, acting on the uppermost sheet of the stack of sheets stacked on the base plate, increases, but only slightly.

The frictional resistance Fc of the friction member provided with respect to the bottom sheet of the stack of sheets stacked on the base plate changes according to the variation in the friction coefficient of the friction member. Moreover, because a reaction force, corresponding to the pulling force Fa from the feeding roller, acts on the friction member via the stack of sheets stacked on the base plate, the frictional resistance Fc further changes. Thus, the frictional resistance Fc changes goes through a larger magnitude of change than does either the pulling force Fa or the frictional resistance Fb.

When the sheet feeding device is configured such that the base plate is moved toward the feeding roller for sheet feeding and is moved away from the feeding roller during the intervals of sheet feeding, as disclosed in Japanese Patent Laid-Open Publication No. 9-202475, the position of the base plate, when moved toward the feeding roller, changes according to the amount of play of a rotation support part of the base plate. This further increases the variation in the frictional resistance Fc.

Further, when the sheet feeding device is configured such that the base plate is inclined downwardly (i.e., from the side of the rotation center of the base plate toward the side on which the feeding roller is located), in order to reduce the installation space for the sheet feeding device in the horizontal direction, the inclination of the base plate relative to the vertical direction increases as the number of sheets of the stack of sheets stacked on the base plate increases. Thus, the stack of sheets stacked on the base plate tends to plunge between the feeding roller and the friction member under the weight of the stack of sheets. Such a plunging of the stack of sheets is more remarkable as the size of the sheets increases and thus, the phenomenon of double feeding of the sheets tends to occur more easily. Therefore, to avoid double feeding of sheets, the value of the frictional resistance Fc needs to be set relatively high. It is difficult to properly set the frictional resistance Fc since it should correspond to the inclining angle of the base plate.

SUMMARY OF THE INVENTION

The present invention has been made to solve the above-discussed and other problems of the prior art.

Preferred embodiments of the present invention provide a sheet feeding device that can reliably separate and feed a stack of sheets stacked on a base plate from a first sheet to a last sheet of the stack of sheets.

According to a preferred embodiment of the present invention, a sheet feeding device includes a feeding roller, which is driven to rotate, and a base plate on which to stack sheets to form a stack of sheets. The sheet feeding device is preferably configured to rotate around a supporting axis thereof in directions to contact and separate from the feeding roller. A base plate pressing member is configured to press the base plate toward the feeding roller. A first friction device is arranged in a vicinity of a first part of an upper surface of the base plate opposing the feeding roller. The first friction device provides the bottom sheet of the stack of sheets stacked on the base plate with a first frictional resistance greater than a predetermined value. A second friction device is arranged upstream of the first friction device in a sheet feeding direction and provides the bottom sheet of the stack of sheets stacked on the base plate with a second frictional resistance greater than the predetermined value discussed with respect to the first frictional resistance.

Thus, when the base plate is biased upwardly by the base plate pressing device such that an uppermost sheet of the stack of sheets stacked on the base plate contacts the feeding roller, the first friction device provides a first frictional resistance to a bottom sheet of the stack of sheets stacked on the base plate which is greater than the predetermined value, while receiving a reaction force from the feeding roller via the stack of sheets stacked on the base plate. The second friction device provides a second frictional resistance to the bottom sheet of the stack of sheets stacked on the base plate which is greater than the predetermined value discussed with respect to the first frictional resistance. Thus, the frictional resistance of the last sheet of the stack of sheets stacked on the base plate is set equal to a sum of the first frictional resistance of the first friction device and the second frictional resistance of the second friction device. Accordingly, the frictional resistance of the first friction device, which is opposed by a reaction force from the feeding roller varying according to the number of sheets of the stack of sheets stacked on the base plate, can be set relatively low. Thus, the influence of the reaction force from the feeding roller is decreased, and thereby the frictional resistance on the bottom sheet of the stack of sheets stacked on the base plate can be easily set to a desired value with the second friction device, which receives a relatively small pressing force from the base plate pressing device because of its position near the supporting axis and which most likely does not receive the influence of the reaction force from the feeding roller. Accordingly, the variation in the frictional resistance provided on the bottom sheet of the stack of sheets stacked on the base plate can be easily suppressed, so that the stack of sheets stacked on the base plate can be reliably separated one by one so as to prevent double-feeding.

In the above-described sheet feeding device, the second friction device may include a second friction member arranged on a second part of the upper surface of the base plate, upstream of the first friction device in the sheet feeding direction, and configured to provided the bottom sheet with the second frictional resistance. Accordingly, by setting material and surface coarseness of the second friction member, the second friction device can be appropriately configured.

Further, the second friction device may include an elastic sheet thrusting device. The elastic thrusting device is arranged upstream of the first friction device in the sheet feeding device and is configured to thrust the stack of sheets stacked on the base plate to a second part of the upper surface of the base plate so that the bottom sheet is provided with the second frictional resistance via the second part of the upper surface of the base plate. In this case, the sheet thrusting device can be appropriately configured by setting the coefficient of elasticity and the dimension thereof.

Furthermore, the second friction device may include a second friction member. The second friction member is arranged on a second part of the upper surface of the base plate, upstream of the first friction device in the sheet feeding direction. The second friction device may also include an elastic sheet thrusting device. The elastic sheet thrusting device is arranged upstream of the first friction device in the sheet feeding direction and is configured to thrust the stack of sheets stacked on the base plate to the second friction member. The second friction member is configured to provide the bottom sheet, of the stack of sheets stacked on the base plate and that are thrust by the sheet thrusting device, with the second frictional resistance. In this case, the bottom sheet of the stack of sheets stacked on the base plate is provided with the second frictional resistance by thrusting of the stack of sheets to the second friction member with the sheet thrusting device, and thereby the bottom sheet of the stack of sheets stacked on the base plate is provided with the second frictional resistance via synergism of the thrusting force of the sheet thrusting device and friction between the second friction member and the bottom sheet. Therefore, relatively large freedom is obtained in a design of the sheet thrusting device and the second friction member.

Still furthermore, the sheet feeding device may include a base plate moving device configured to allow the base plate to move toward the feeding roller when the feeding roller feeds the uppermost sheet of the stack of sheets stacked on the base plate, such that the uppermost sheet of the stack of sheets contacts the feeding roller so as to be fed by the feeding roller, and to cause the base plate to retreat from the feeding roller when the fed sheet is conveyed to a conveying member in a downstream side of the sheet feeding device.

Accordingly, even when a structure in which a feeding roller is continuously rotated is employed in the sheet feeding device, the stack of sheets stacked on the base plate can be intermittently fed by movement of the base plate toward the feeding roller and by the retreating movement of the base plate from the feeding roller. In this case, because the sheet feeding device includes the base plate moving device, the position of the base plate when moved toward the feeding roller may change more greatly than when a structure not having the base plate moving device is employed in the feeding device. Therefore, the first frictional resistance, provided on the bottom sheet of the stack of sheets stacked on the base plate by the first friction member, may also change more greatly than when the structure not having the base plate moving device is employed, according to a change in the reaction force from the feeding roller. However, by setting the first frictional resistance, provided on the bottom sheet of the stack of sheets stacked on the base plate by the first friction member, to be relatively small and by setting the second frictional resistance, provided on the bottom sheet of the stack of sheets stacked on the base plate via the second friction member which most likely does not receive the influence of the reaction force from the feeding roller, to a desired value, even when the structure in which the base plate is moved toward and retreated from the feeding roller is used, the variation in the frictional resistance, provided on the bottom sheet of the stack of sheets stacked on the base plate, can be easily suppressed.

Further, in the above sheet feeding device, the base plate may be downwardly inclined from the supporting axis side toward the feeding roller side thereof.

When a structure in which the sheet stacking surface of the base plate is inclined downwardly from the side of the supporting axis toward the side of the feeding roller is employed in the sheet feeding device, for example, for reducing the installation space for the sheet feeding device in the horizontal direction, as the number of stacked sheets on the base plate increases, the inclination angle of the base plate increases relative to the vertical angle, and thereby the stack of sheets stacked on the base plate tend to plunge between the feeding roller and the second friction member under the force of their own weight. However, by appropriately setting the first and second frictional resistances, to be provided to the bottom sheet of the stack of sheets stacked on the base plate via the first and second friction devices, respectively, as described above, such plunging of the stack of sheets is prevented.

Furthermore, when a pulling force of the feeding roller acting on the uppermost sheet of the stack of sheets stacked on the base plate is Fa, a frictional resistance acting between the stack of sheets stacked on the base plate is Fb, the first frictional resistance provided on the bottom sheet of the stack of sheets stacked on the base plate via the first friction device is Fc, the second frictional resistance provided on the bottom sheet of the stack of sheets stacked on the base plate via the second friction device is Fd, and a third frictional resistance provided on the bottom sheet of the stack of sheets stacked on the base plate via a part of the upper surface of the base plate, where the first or second frictional resistance Fc or Fd of the first or second friction device, respectively, is not provided on the bottom sheet, is Fe, a relationship of $Fa>(Fc+Fd+Fe)>Fb$ may be satisfied. In addition, a relationship of $Fc>Fd$ may be satisfied.

Accordingly, when the uppermost sheet of the stack of sheets stacked on the base plate is to be fed, the uppermost sheet easily slips relative to adjacent and subsequent sheets of the stack of sheets stacked on the base plate. Further, even when a sheet on the base plate is the last sheet of the stack of sheets, the last sheet can be pulled out from its position against the base plate while resisting the frictional resistances provided by the first and second friction devices. Thus, the reliability of separating and feeding the stack of sheets stacked on the base plate, from a first sheet to a last sheet of the stack of sheets, can be further enhanced. Also, the sheet separation performance of the feeding roller is enhanced, and thereby the burden on a separation/friction member, arranged on the downstream side of the sheet feeding roller in the sheet feeding direction, can be reduced, so that the reliability of separating the stacked sheet is further enhanced.

Further, the sheet feeding device may include a separation/friction member arranged to oppose the feeding roller and configured to prevent other sheets, besides the uppermost sheet of the stack of sheets stacked on the base plate, from being fed by the feeding roller. Accordingly, even when the feeding roller pulls out a plurality of sheets from the stack of sheets stacked on the base plate, double feeding of the sheets is prevented by the frictional resistance of the separation/friction member.

Furthermore, in the above sheet feeding device, the sheet thrusting device may include a sheet member having elasticity. Thereby, the structure of the sheet thrusting device can be simplified, so that the sheet feeding device can be made inexpensive.

Further, at least one of the first friction device and the second friction member may be formed from cork or resin, so as to be inexpensive.

According to another embodiment of the present invention, an image forming apparatus includes a sheet feeding device having a feeding roller that is driven to rotate and a base plate to stack sheets thereupon. The sheet feeding device is configured to rotate around a supporting axis thereof in directions to contact and separate from the feeding roller. In the sheet feeding device, a base plate pressing member is configured to press the base plate to be rotated toward the feeding roller such that an uppermost sheet of the stack of sheets stacked on the base plate contact the feeding roller so as to be fed by the feeding roller. The sheet feeding device includes a first friction device, which is arranged on an upper surface of the base plate in a vicinity of a first part of the upper surface of the base plate opposing the feeding roller to provide a bottom sheet of the stack of sheets stacked on the base plate with a first frictional resistance which is greater than a predetermined value. The sheet feeding device also includes a second friction device, which is arranged upstream of the first friction device in a sheet feeding direction to provide the bottom sheet of the stack of sheets stacked on the base plate with a second frictional resistance greater than the predetermined value discussed with respect to the first friction device. The image forming apparatus further includes a sheet conveying member configured to receive and convey the sheet fed from the sheet feeding device, and a printer configured to print an image on the sheet conveyed by the sheet conveying member.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, wherein.

DETAILED DESCRIPTION OF THE PREFERRED EMBODIMENTS

Figure 1:
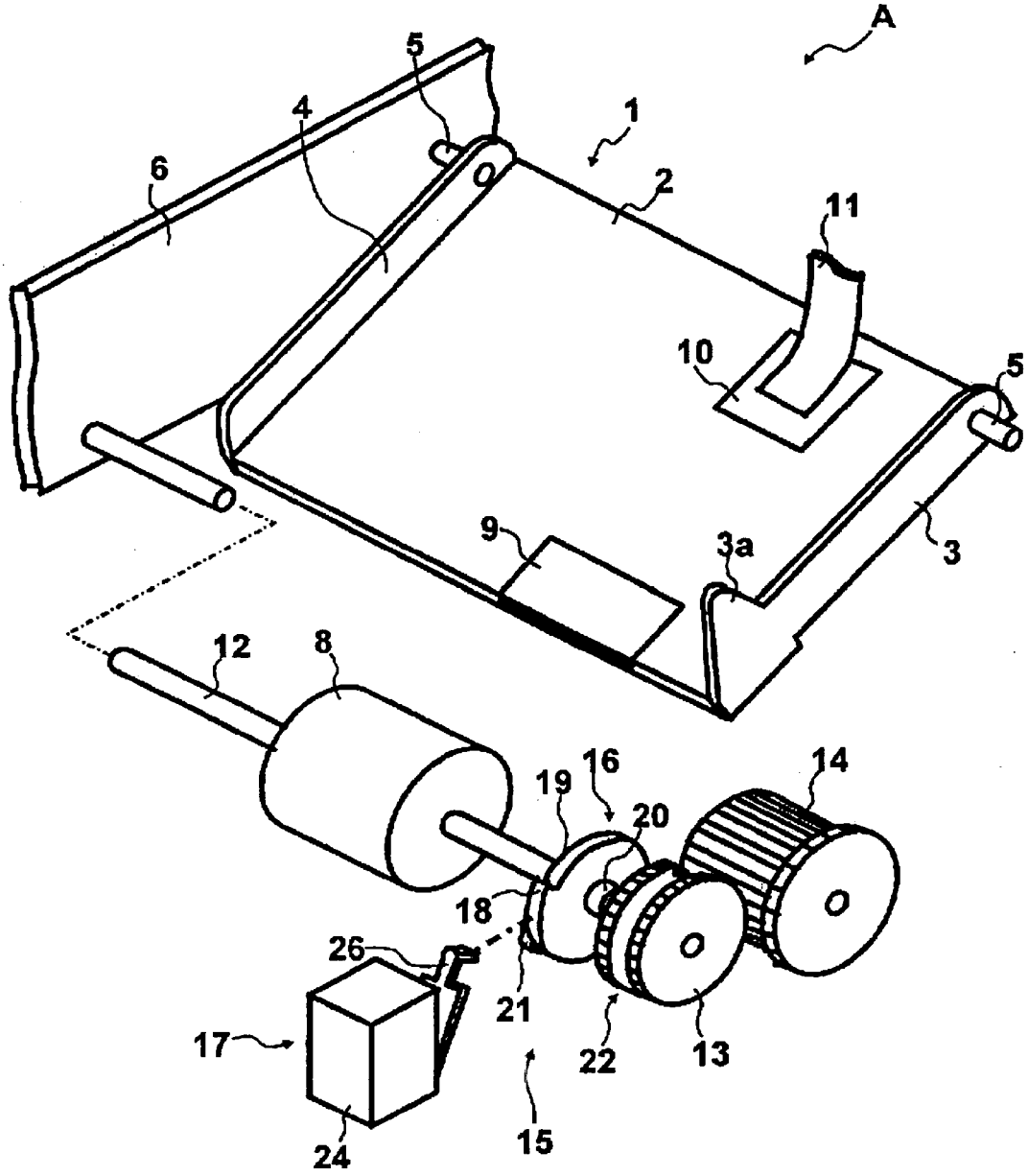
FIG. 1 is a disassembled perspective view of a sheet feeding device A according to a preferred embodiment of the present invention.

In the drawings, like reference numerals designate identical or corresponding parts throughout the several views, such that preferred embodiments of the present invention will now be described.

As illustrated in FIG. 1, a base plate 1 includes a sheet stacking surface 2 for stacking sheets S (see FIG. 2) thereupon, and a pair of right and left side plates 3, 4. The base plate 1 is supported by a frame 6 via a supporting axis 5 that is installed on the side plates 3, 4 in a standing condition, so as to be rotatable upwardly and downwardly. The frame 6 is configured to be a pair of left and right side frames, but the right side frame opposing the side plate 3 is omitted in FIG. 1 for clarity of view.

The base plate 1 is pressed toward a feeding roller 8 by a base plate pressing member 7 (see FIG. 2) including a contracting coil spring. The base plate 1 includes the side plates 3, 4, and in this example, is formed of a sheet metal by a press processing, such that its surface is flat so that the sheet s may slide well across its surface. Further, on an upper surface of the sheet stacking surface 2 of the base plate 1, a first friction member 9, functioning as a first friction device, is arranged in the vicinity of a surface of the sheet stacking surface 2 opposing the feeding roller 8, and a second friction member 10 and a sheet thrusting device 11, functioning as a second friction device, are arranged at the side of the supporting axis 5, i.e., at the upstream side of the first friction member 9 in the sheet feeding direction. The friction members 9, 10 provide the bottom sheet of the stack of sheets S with a frictional resistance, and are formed of inexpensive material, such as cork or urethane resin. The sheet thrusting device 11 includes an elastic sheet member so as to press the stack of sheets S stacked on the base plate 1 against the second friction member 10.

Figure 2:
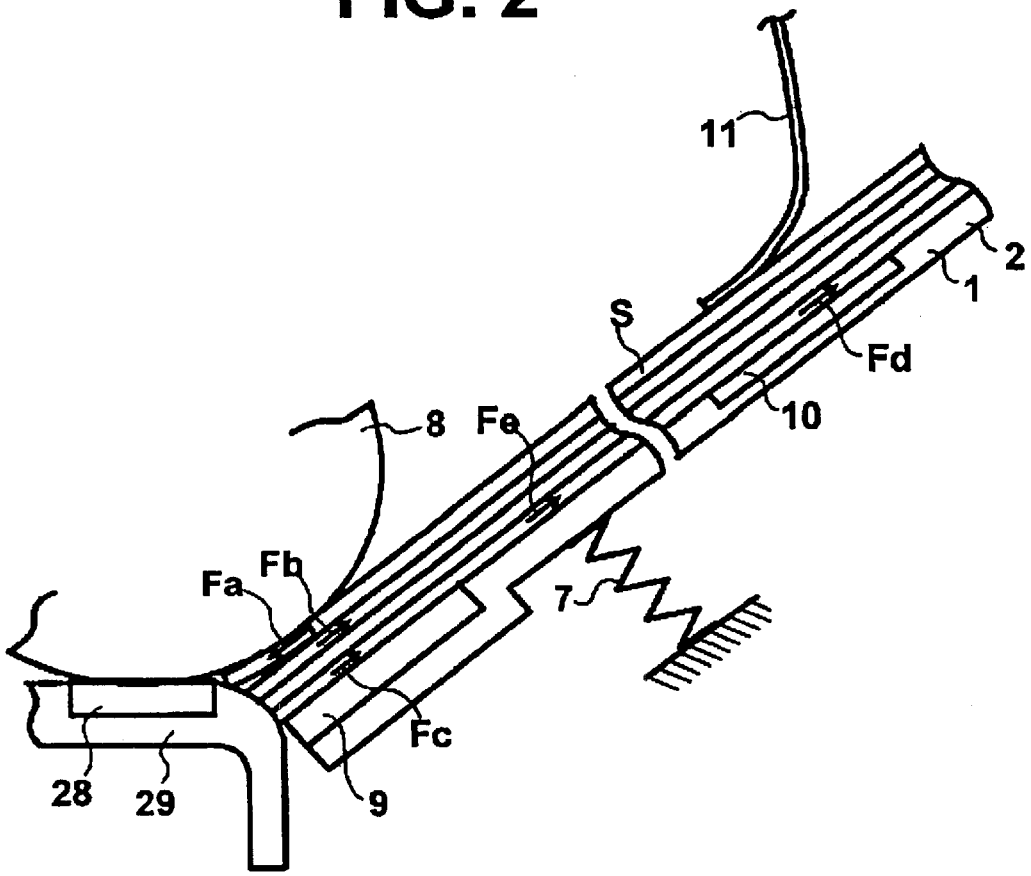
FIG. 2 is a cross-sectional view of a part of the sheet feeding device A of FIG. 1.

In the sheet feeding device A, as illustrated in FIG. 2, a pulling force Fa of the feeding roller 8 acts on an uppermost sheet of the stack of sheets S stacked on the base plate 1 when the feeding roller 8 feeds out the uppermost sheet. The sheet feeding device A also has a frictional resistance Fb acting between the sheets of the stack of sheets S stacked on the base plate 1, a first frictional resistance Fc provided on a bottom sheet of the stack of sheets S stacked on the base plate 1 via the first friction member 9, a second frictional resistance Fd provided on the bottom sheet of the stack of sheets S stacked on the base plate via the second friction member 10, the stack of sheets S stacked on the base plate 1 having been thrust by the sheet thrusting device 11 toward the base plate 1, and a third frictional resistance Fe provided on the bottom sheet of the stack of sheets S stacked on the base plate 1 by a part of the flat surface of the base plate 1 when the first or second friction member 9 or 10 is not provided so that the relationship of $Fa>(Fc+Fd+Fe)>Fb$ is satisfied. The relationship of $Fc>Fd$ is also satisfied, and the third frictional resistance Fe is small and negligible because the base plate 1 is formed from a sheet metal, such that its surface is flat in order for a sheet s of the stack of sheets S to slip well relative thereto.

In this embodiment, the first friction member 9 provides the bottom sheet of the stack of sheets S stacked on the base plate 1 with the first frictional resistance Fc, which is greater than a predetermined value, i.e., the value of the first frictional resistance Fc is greater than a criterion value corresponding to a frictional resistance provided with respect to the bottom sheet of the stack of sheets S stacked on the base plate 1 via the base plate 1 at a part of the flat surface of the base plate 1, when the first or second friction member 9 or 10 is not provided, and when the bottom sheet contacts the base plate 1 under the force of the weight of the stack of sheets S. Similarly, the second friction member 10 provides the bottom sheet of the stack of sheets S stacked on the base plate 1 and thrust by the sheet thrusting device 11, with the second frictional resistance Fd, which is greater than the predetermined value discussed with respect to the first friction member 9, i.e., the value of the second friction resistance Fd is greater than the criterion value corresponding to the frictional resistance given to the bottom sheet of the stack of sheets S stacked on the base plate 1 via the base plate 1 at the part of the flat surface of the base plate 1, when the first or second friction member 9 or 10 is not provided, and when the bottom sheet contacts the base plate 1 under the force of the weight of the stack of sheets S.

In the sheet feeding device A, by selecting proper material for the second friction member 10 or by properly setting the surface coarseness of the second friction member 10, without providing the sheet thrusting device 11, the bottom sheet of the stack of sheets S stacked on the base plate 1 can be provided with the second frictional resistance Fd greater than the predetermined value via only the second friction member 10. Alternatively, by properly configuring the sheet thrusting device 11, without the provision of the second friction member 10, the bottom sheet of the stack of sheets S stacked on the base plate 1 can be provided with a third frictional resistance Fe greater than the predetermined value via a reaction force of the base plate 1 in response to a pressing force of the sheet thrusting device 11.

The feeding roller 8 is fixed to a roller axis 12 rotatably supported by the frame 6. A feeding roller gear 13 is fixed to the roller axis 12. The feeding roller gear 13 is engaged with a driving gear 14 driven by a motor (not illustrated).

In this embodiment, the sheet feeding device A further includes a base plate moving device 15 configured to allow the base plate 1 to move toward the feeding roller 8 with the base plate pressing member 7 when the feeding roller 8 feeds the uppermost sheet of the stack of sheets S stacked on the base plate 1, and configured to allow the base plate 1 to retreat from the feeding roller 8 when the fed sheet is transferred to a sheet conveying member (described later as a registration roller) at the downstream side of the sheet feeding device A in the sheet feeding direction.

Figure 3:
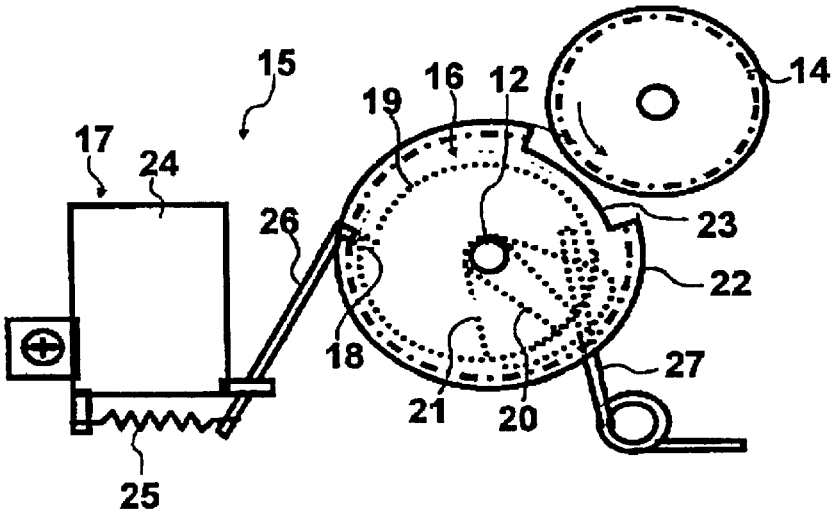
FIG. 3 is a front view illustrating a construction of a base plate moving device of the sheet feeding device A of FIG. 1.

The base plate moving device 15 includes, as illustrated in FIG. 3, a cam 16 rotatably engaged with the roller axis 12 and a magnet 17. The magnet 17 has the function of a clutch to stop the cam 16 at a constant position each time the cam 16 makes one revolution. The cam 16 includes a cam plate 19 having a stopping claw 18 formed at a part of its outer circumference, a protrusion 20 formed at a side surface of the cam plate 19 and protruding in the radial direction, a thrusting part 21 formed at the other side surface of the cam plate 19, and a cam gear 22. A notch 23 is formed at a part of the outer circumference of the cam gear 22 so as to avoid engagement of the cam gear 22 with the driving gear 14. The thrusting part 21 is formed in a shape such that the thrusting part 21 thrusts a protruding piece 3*a* (FIG. 1) formed in the side plate 3 of the base plate 1 and the base plate 1 is moved upwardly and downwardly to make one round trip when the cam 16 makes one revolution, i.e., in a shape that the radius from the rotational center of the cam plate 19 continuously changes.

As illustrated in FIG. 3, the magnet 17 includes a coil 24, a spring 25, and a movable iron rod 26 pressed toward the cam plate 19 by the spring 25. A tip end of the movable iron rod 26 is bent such that the movable iron rod 26 is separated from the cam plate 19 when electricity to the coil 24 is turned on, is rotated toward the cam plate 19 by a pressing force of the spring 25 when the electricity to the coil 24 is turned off, so as to contact the outer circumference of the cam plate 19, and is stopped by the stopping claw 18 when the stopping claw 18 has reached a position opposing the movable iron rod 26 during the revolution of the cam plate 19.

Further, as illustrated in FIG. 3, a returning coil spring 27 is provided so as to press the protrusion 20 of the cam 16 in the clockwise direction and to activate the cam 16 in the clockwise direction when the movable iron rod 26 is released from the stopping claw 18 of the cam 16. When the cam 16 is activated, the notch 23 of the cam gear 22 is also moved in the clockwise direction so that the cam gear 22 engages the driving gear 14. Thereafter, the cam 16 is rotated by receiving the driving force of the driving gear 14. The cam 16 is stopped by the magnet 17 each time the cam 16 makes one revolution. The cam 16 causes the base plate 1 to move toward and retreat from the feeding roller 8 each time the cam 16 makes one revolution. That is, the returning coil spring 27 and the driving gear 14 also function as a part of the base plate moving device 15.

Figure 4A:
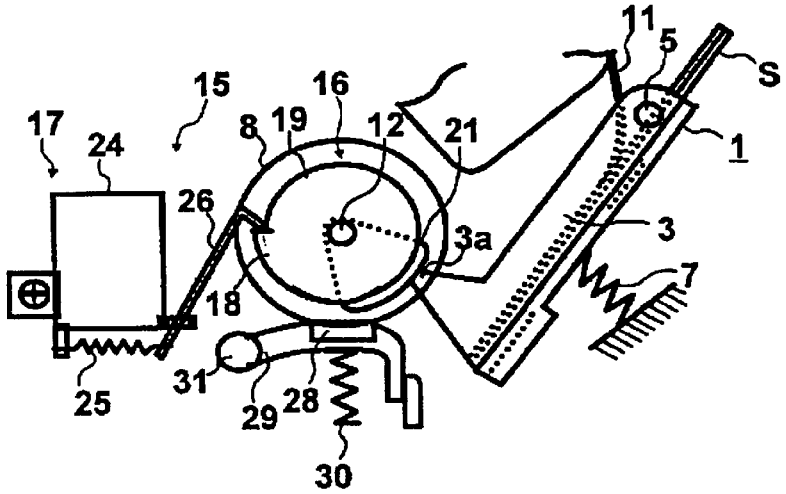
FIGS. 4(*a*), 4(*b*) and 4(*c*) are front views of the sheet feeding device A of FIG. 1 for explaining the operation of the base plate moving device of FIG. 3.
Figure 4B:
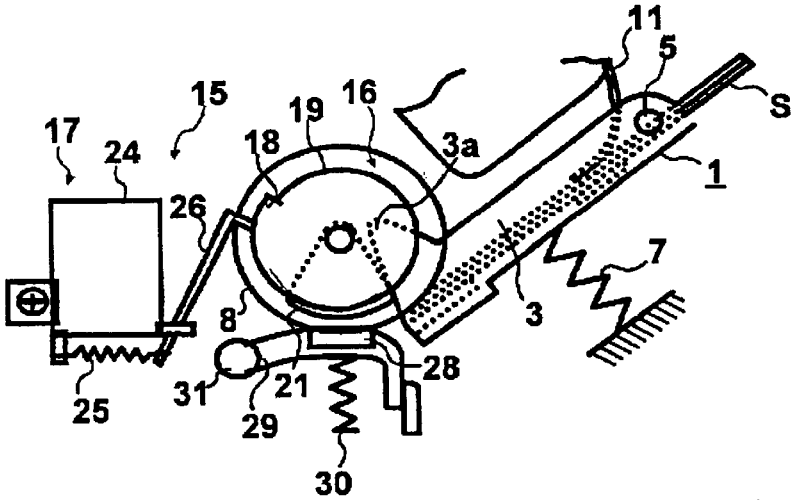
Figure 4C:
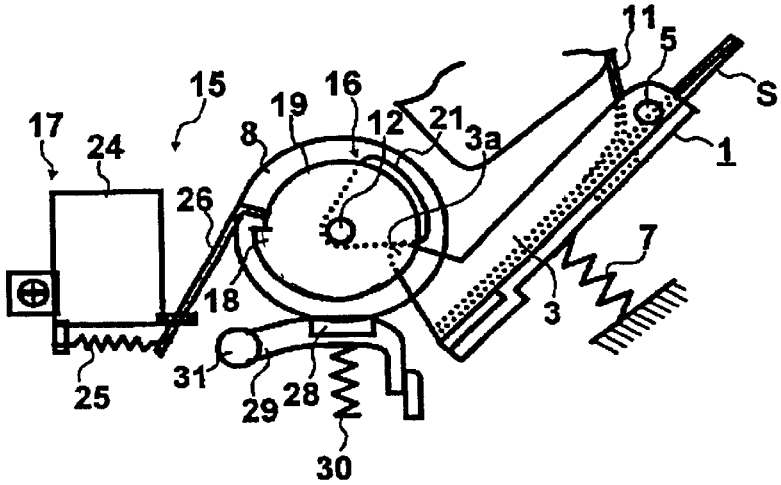

As illustrated in FIGS. 4(*a*)–4(*c*), a separation/friction member 28 is provided downstream of the sheet feeding device A so as to oppose the feeding roller 8, so that even when a plurality of sheets are pulled out of the stack of sheets S stacked on the base plate 1, the plurality of sheets S which have been pulled out are separated by the feeding roller 8 and the separation/friction member 28. The separation/friction member 28 is formed from material having a relatively high coefficient of friction and is supported by an arm 29. The arm 29 is pressed toward the feeding roller 8 by a spring 30, and is supported on an axis 31 so as to rotatable around the axis 31.

Figure 5:
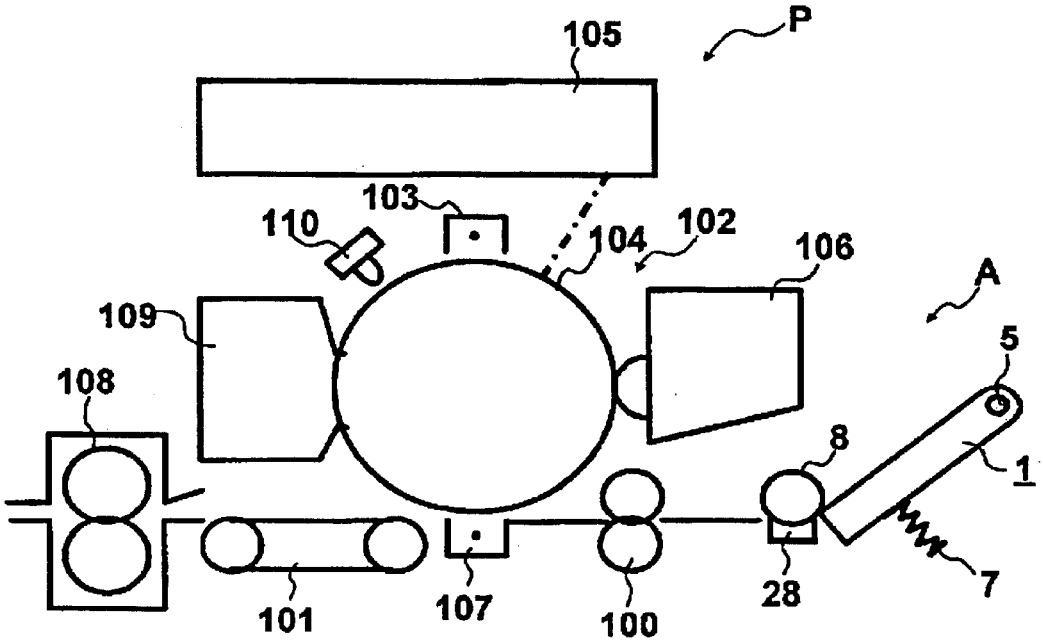
FIG. 5 is a schematic drawing illustrating a construction of an image forming apparatus using a sheet feeding device according to another preferred embodiment of the present invention.

Now, an exemplary construction of an image forming apparatus P, having the above-described sheet feeding device A installed therein, is described hereinafter, with reference to FIG. 5. The image forming apparatus P includes a registration roller 100 and a conveying belt 101, functioning as a sheet conveying member to receive and convey a sheet fed by the sheet feeding device A, and a printer 102 to print an image on the sheet conveyed by the registration roller 100 and the conveying belt 101. The printer 102 has a configuration of known eletrophotography, and is configured to uniformly charge the surface of a photoconductor 104 with a charger 103, and to develop an electrostatic latent image formed on the charged surface of the photoconductor 104 by an optical writing device 105 with a developing device 106. The printer 102 further transfers the developed image to a sheet with a transfer device 107, and fixes the transferred image onto the sheet with a fixing device 108. The printer 102 then cleans the surface of the photoconductor 104 for subsequent image formation with a cleaning unit 109, and discharges the outer circumference of the photoconductor 104 with a discharger 110. It is needless to say that the image forming apparatus P may have a configuration different from that of electrophotography.

In the image forming apparatus P, when the power is turned on, a motor (not shown), for a sheet conveying system of the image forming apparatus P, is driven, and thereby the driving gear 14 of the sheet feeding device A is always rotated, so that the feeding roller gear 13 and the feeding roller 8 are always rotated (see FIG. 1). However, until a print start signal is input to the printer 102, rotating members of the sheet conveying system of the image forming apparatus P remain stopped. In this state, i.e., a printing wait state, as illustrated in FIG. 3, even though the cam 16 is pressed in the clockwise direction by the returning coil spring 27, because the movable iron rod 26 of the magnet 17 is stopped by the stopping claw 18, the cam 16 remains in a constant position in which the notch 23 opposes the driving gear 14.

In this state, as illustrated in FIG. 4(*a*), because the thrusting part 21 of the cam 16 thrusts the protrusion 3*a* of the base plate 1 at a part thereof having a larger radius, the base plate 1 is moved downwardly relative to the feeding roller 8 to be positioned in a retreated position from the feeding roller 8. Thereby, the stack of sheets S stacked on the base plate 1 is separated from the feeding roller 8.

Upon inputting of a print start signal to the printer 102, an image forming operation of the printer 102 starts, and the sheet feeding device A starts a feeding operation by providing electricity to the coil 24 of the magnet 17. By providing electricity to the coil 24, the movable iron rod 26 is released from the stopping claw 18 of the cam plate 19, so that the cam 16 rotates in the clockwise direction by a pressing force of the returning coil spring 27. The pressing force of the returning coil spring 27 acts on the cam 16 only in an initial stage of a revolution of the cam 16. However, the cam gear 22 is engaged with the driving gear 14 (FIG. 3) by this initial revolution of the cam 16, such that the cam 16 is rotated in the clockwise direction.

With the rotation of the cam 16 as described above, as illustrated in FIG. 4(*b*), the part of the thrusting part 21 having a larger radius separates from the protrusion 3*a* of the base plate 1, such that the base plate 1 is rotated around the supporting axis 5 to be moved toward the feeding roller 8 by a pressing force of the base plate moving device 15. Thereby, an uppermost sheet of the stack of sheets S stacked on the base plate 1 contacts the feeding roller 8, so as to be pulled out from the base plate 1 by the feeding roller 8, which is always rotating. At this time, even when a plurality of sheets of the stack of sheets S are pulled out from the base plate 1, adjacent or subsequent sheets to the plurality of sheets that have been pulled out receive frictional resistance from the separation/friction member 28 so as to be stopped. Thus, double feeding of the sheets of the stack of sheets S is prevented.

In a later process of the revolution of the cam 16, the thrusting part 21 presses the protrusion piece 3*a* of the base plate 1 at a part thereof where the radius gradually increases. Therefore, the base plate 1 moves, as illustrated in FIG. 4(*c*), downwardly to a retreated position, and when the cam 16 completes one revolution, the base plate 1 is positioned at the retreated position illustrated in FIG. 4(*a*).

Thus, because the provision of electricity to the coil 24 is stopped at the last moment of the revolution of the cam 16, the movable iron rod 26 is returned to the side of the cam plate 19 by a pressing force of the spring 25 such that the tip end thereof contacts an outer circumference of the cam plate 19, and when the stopping claw 18 reaches the position of the tip end of the movable iron rod 26, the stopping claw 18 and the movable iron rod 26 are engaged with each other so that the cam 16 is stopped at the constant position.

As described above, each time a print start signal is input to the printer 102, by driving the magnet 17 to rotate the cam 16 to make one revolution, and during one revolution of the cam 16, by causing the base plate 1 to move toward the feeding roller 8 so that an uppermost sheet of stack of sheets S stacked on the base plate 1 contacts the feeding roller 8 so as to be fed by the feeding roller 8 and to retreat to a retreated position so as to be separated from the stack of sheets S stacked on the base plate 1 after feeding of the uppermost sheet has been completed, even when a configuration in which the feeding roller 8 is always rotated is employed, the stack of sheets S stacked on the base plate 1 can be intermittently fed. In this case, the base plate 1 is caused to retreat to the retreated position at least after a leading edge of the sheet pulled out of the stack of sheets S stacked on the base plate 1 has reached a nip portion of the registration roller 100 acting as a sheet conveying member provided in the downstream side of the sheet feeding device A.

When a pulling force Fa of the feeding roller 8 acts on the uppermost sheet of the stack of sheets S stacked on the base plate 1 and the feeding roller 8 feeds the uppermost sheet, a frictional resistance Fb acts between the sheets of the stack of sheets S stacked on the base plate 1, a first frictional resistance Fc is provided on the bottom sheet of the stack of sheets S stacked on the base plate 1 via the first friction member 9, a second frictional resistance Fd is provided on the bottom sheet of the stack of sheets S stacked on the base plate 1 via the second friction member 10, the stack of sheets S having been thrust by the sheet thrusting device 11 toward the base plate 1, and a third frictional resistance Fe is provided on the bottom sheet of the stack of sheets S stacked on the base plate 1 by a part of the flat surface of the base plate 1 when the first or second friction member 9 or 10 is not provided so that a relationship of Fa>(Fc+Fd+Fe)>Fb is satisfied. Therefore, when the uppermost sheet of the stack of sheets S is pulled from the stack of sheets S stacked on the base plate 1, the uppermost sheet easily slips relative to adjacent and subsequent sheets of the stack of sheets S. Further, even when only one sheet (i.e., the last sheet of the stack of sheets S) remains on the base plate 1, the last sheet is pulled out from against the base plate 1 by the feeding roller 8 while resisting the frictional resistance (i.e., Fc+Fd+Fe) provided on the bottom sheet of the stack of sheets S stacked on the base plate 1. Thus, the stack of sheets S stacked on the base plate 1 can be securely separated and fed from the first sheet of the stack of sheets S stacked on the base plate 1 to the last sheet of the stack of sheets S stacked on the base plate 1.

As described above, a known sheet feeding device has been configured such that the relationship of Fa>Fc>Fd is satisfied. The first frictional resistance Fc changes according to a variation in the coefficient of friction of the first friction member 9. Further, because a reaction force of the feeding roller 8 in response to the pulling force Fa acts on the first friction member 9 via the stack of sheets S, the first frictional resistance Fc further changes according to the number of sheets in the stack of sheets S stacked on the base plate 1, namely, according to a contracting amount of the base plate pressing member 7, which changes according to the position of the base plate 1. Thus, variation in the first frictional resistance Fc is greater than those in the pulling force Fa and the frictional resistance Fb.

However, according to the above-described preferred embodiment of the present invention, a total frictional resistance provided on the bottom sheet of the stack of sheets S stacked on the base plate 1 is set by a sum of the first frictional resistance Fc via the first friction member 9, the second frictional resistance Fd via the second friction member 10, and the third frictional resistance Fe via the part of the surface of the base plate 1 when the first or second friction member 9 or 10 is not provided, the third frictional resistance Fe being small and negligible as described above. Accordingly, the first frictional resistance Fc via the first friction member 9 receiving a reaction from the feeding roller 8, which changes according to the number of stack of sheets S stacked on the base plate 1, can be set relatively low, such that the influence of the reaction force from the feeding roller 8 is decreased, and thereby the total frictional resistance (i.e., Fc+Fd+Fe) to be given to the bottom sheet of the stack of sheets S stacked on the base plate 1 can be easily set to a desired value with the sheet thrusting device 11, and the second friction member 10 receives a relatively small pressing force of the base plate pressing device 7, and most likely does not receive the influence of the reaction force from the feeding roller 8, because of its position near the supporting axis 5.

In the above-described embodiments, because the sheet feeding device A includes the base plate moving device 15, the position of the base plate 1 when moved toward the feeding roller 8 may change when compared to a structure not having the base plate moving device 15. Therefore, the frictional resistance Fc, provided on the bottom sheet of the stack of sheets S stacked on the base plate 1 via the first friction member 9, is changed according to a change in the reaction force from the feeding roller 8. However, by setting the frictional resistance Fc to be relatively small and by setting the frictional resistance Fd, provided on the bottom sheet of the stack of sheets S stacked on the base plate 1 via the second friction member 10 which is not easily influenced by the reaction force from the feeding roller 8, to a desired value, even when a construction in which the base plate 1 is moved toward and retreated from the feeding roller 8 is used, the variation in the frictional resistance (i.e., Fc+Fd+Fe), provided on the bottom sheet of the stack of sheets S stacked on the base plate 1, can be suppressed.

Further, in the above-described embodiments, because the sheet stacking surface 2 of the base plate 1 is inclined downwardly from the side of the supporting axis 5 toward the side of the feeding roller 8, as the number sheets of the stack of sheets S stacked on the base plate 1 increases, the inclination angle between the upper surface of the base plate 1 and the vertical decreases (i.e., the upper surface of the base plate 1 becomes more downwardly inclined with respect to the vertical), and thereby the stack of sheets S stacked on the base plate 1 tends to plunge between the feeding roller 8 and the first friction member 9 under the weight of the stack of sheets S. However, as described above, because the variation in the frictional resistance (i.e., Fc+Fd+Fe) to be provided on the bottom sheet of the stack of sheets S stacked on the base plate 1 can be suppressed, such plunging of the stack of sheets S stacked on the base plate 1 can be prevented.

Further, because the first frictional resistance Fc and the second frictional resistance Fd are set so as to satisfy the relationship of Fc>Fd, the sheet separating performance at the feeding roller 8 is enhanced. Thereby, with respect to sheet separation, the burden on the separation/friction member 28 is decreased, resulting in enhancing the reliability of sheet separation.

Numerous additional modifications and variations of the present invention are possible in light of the above teachings. It is therefore to be understood that within the scope of the appended claims, the present invention may be practiced otherwise than as specifically described herein.

What is claimed as new and desired to be secured by letters patent of the United States is:

1. A sheet feeding device comprising:

a feeding roller which is driven to rotate;

a base plate having an upper surface of a predetermined surface area upon which a stack of sheets is stacked, said base plate being configured to rotate around a supporting axis located near a rear end thereof in directions to contact and separate from said feeding roller located adjacent to a front end of said base plate, said upper surface of said base plate having a first part located adjacent said front end thereof and a second part located adjacent said rear end thereof, and said base plate being formed of a sheet metal material having relatively little frictional resistance;

a base plate pressing member configured to press said base plate to be rotated toward said feeding roller such that an uppermost sheet of the stack of sheets stacked on said base plate contacts said feeding roller so as to be fed by said feeding roller;

a first friction device including a first friction member arranged in said first part of said upper surface of said base plate so as to oppose said feeding roller, said first friction member being made of a first frictional material which provides a bottom sheet of the stack of sheets stacked on said base plate with a first frictional resistance Fc greater than a predetermined value; and a second friction device including a second friction member arranged upstream of said first friction member in a sheet feeding direction, said second friction member being made of a second frictional material which provides the bottom sheet of the stack of sheets stacked on said base plate with a second frictional resistance Fd greater than the predetermined value, said second frictional material being different from said sheet metal material of said base plate.

2. The sheet feeding device of claim 1, wherein said second friction member is embedded in said second part of said upper surface of said base plate so that an upper surface of said second friction member is flush with said upper surface of said base plate and a rear end of said second friction member is slightly spaced from said rear end of said base plate, said upper surface of said second friction member having a relatively small surface area as compared to said predetermined surface area of said upper surface of said base plate.

3. The sheet feeding device of claim 1, wherein said second friction device includes an elastic sheet thrusting device arranged upstream of said first friction member in said sheet feeding direction, said elastic sheet thrusting device being configured to thrust the stack of sheets stacked on said base plate to said second part of said upper surface of said base plate so that the bottom sheet of the stack of sheets stacked on said base plate is provided with both said second frictional resistance Fd from said second friction member and a third frictional resistance Fe from said second part of said upper surface of said base plate.

4. The sheet feeding device of claim 3, wherein said sheet thrusting device includes a sheet member having elasticity.

5. The sheet feeding device of claim 1, wherein said second friction device includes an elastic sheet thrusting device arranged upstream of said sheet feeding device and configured to thrust the stack of sheets stacked on said base plate to said second friction member, said second friction member being configured to provide the bottom sheet, of the stack of sheets stacked on said base plate and being thrust by the sheet thrusting device, with said second frictional resistance Fd.

6. The sheet feeding device of claim 1, further comprising a base plate moving device configured to allow said base plate to move toward said feeding roller when said feeding roller feeds the uppermost sheet of the stack of sheets stacked on said base plate, such that the uppermost sheet of the stack of sheets stacked on said base plate contacts said feeding roller so as to be fed by said feeding roller, and said base plate moving device also being configured to allow said base plate to move away from said feeding roller when a sheet fed by said feeding roller is conveyed to a conveying member on a downstream side of said sheet feeding device.

7. The sheet feeding device of claim 1, wherein said base plate is inclined downwardly from said rear end of said base plate near where said supporting axis is located toward said front end of said base plate which is adjacent to said feeding roller.

8. The sheet feeding device of claim 1, wherein a pulling force Fa of said feeding roller acts on the uppermost sheet of the stack of sheets stacked on said base plate, an inter-sheet frictional resistance Fb acts between sheets of the stack of sheets stacked on said base plate, said first frictional resistance Fc is provided on the bottom sheet of the stack of sheets stacked on said base plate via said first friction member, said second frictional resistance Fd is provided on the bottom sheet of the stack of sheets stacked on said base plate via said second friction member, and a third frictional resistance Fe is provided on the bottom sheet of the stack of sheets stacked on said base plate via a portion of said upper surface of said base plate when any one of said first frictional resistance Fc of the first friction member or said second frictional resistance Fd of said second friction member is not provided on the bottom sheet of the stack of sheets stacked on said base plate so that a relationship of $Fa>(Fc+Fd+Fe)>Fb$ is satisfied.

9. The sheet feeding device of claim 8, wherein a relationship of $Fc>Fd$ is satisfied.

10. The sheet feeding device of claim 1, further comprising a separation/friction member arranged to oppose said feeding roller, said separation/friction member being configured to prevent other sheets, besides the uppermost sheet of the stack of sheets stacked on said base plate, from being fed by said feeding roller.

11. The sheet feeding device of claim 1, wherein said first frictional material of said first friction member is cork, and said second frictional material of said second friction member is resin.

12. The sheet feeding device of claim 1, wherein said first frictional material of said first friction member is resin and said second frictional material of said second friction member is cork.

13. The sheet feeding device of claim 1, wherein said first frictional material of said first friction member and said second frictional material of said second friction member are a same material which is cork.

14. The sheet feeding device of claim 1, wherein said first frictional material of said first friction member and said second frictional material of said second friction member are a same material which is resin.

15. The image forming apparatus of claim 1, wherein said sheet feeding device further includes a separation/friction member arranged to oppose said feeding roller, said separation/friction member being configured to prevent other sheets, besides the uppermost sheet of the stack of sheets stacked on the base plate, from being fed by said feeding roller.

16. An image forming apparatus comprising:

a sheet feeding device including:

a feeding roller which is driven to rotate;

a base plate having an upper surface of a predetermined surface area upon which a stack of sheets is stacked, said base plate being configured to rotate around a supporting axis located near a rear end thereof in directions to contact and separate from said feeding roller located adjacent to a front end of said base plate, said upper surface of said base plate having a first part located adjacent said front end thereof and a second part located adjacent said rear end thereof, and said base plate being formed of a sheet metal material having relatively little frictional resistance;

a base plate pressing member configured to press said base plate to be rotated toward said feeding roller such that an uppermost sheet of the stack of sheets stacked on said base plate contacts said feeding roller so as to be fed by said feeding roller;

a first friction device including a first friction member arranged in said first part of an upper surface of said base plate so as to oppose said feeding roller, and said first friction member being made of a first frictional material which provides a bottom sheet of the stack of sheets stacked on said base plate with a first frictional resistance Fc greater than a predetermined value; and a second friction device including a second friction member arranged upstream of said first friction member in a sheet feeding direction, said second friction member being made of a second frictional material which provides the bottom sheet of the stack of sheets stacked on said base plate with a second frictional resistance Fd greater than the predetermined value, said second frictional material being different from said sheet metal material of said base plate;

a sheet receiving/conveying member configured to receive and convey a sheet fed from said sheet feeding device; and a printer configured to print an image on the sheet fed from said sheet feeding device and received and conveyed by said sheet receiving/conveying member.

17. The image forming apparatus of claim 16, wherein said second friction member is embedded in said second part of said upper surface of said base plate so that an upper surface of said second friction member is flush with said upper surface of said base plate and a rear end of said second friction member is slightly spaced from said rear end of said base plate, said upper surface of said second friction member having a relatively small surface area as compared to said predetermined surface area of said upper surface of said base plate.

18. The image forming apparatus of claim 16, wherein said second friction device includes an elastic sheet thrusting device arranged upstream of said first friction device in said sheet feeding direction, said elastic sheet thrusting device being configured to thrust the stack of sheets stacked on said base plate to said second part of said upper surface of said base plate so that the bottom sheet of the stack of sheets stacked on said base plate is provided with said second frictional resistance Fd from said second friction member and a third frictional resistance Fe from said second part of said upper surface of said base plate.

19. The image forming apparatus of claim 18, wherein said sheet thrusting device includes a sheet member having elasticity.

20. The image forming apparatus of claim 16, wherein said second friction device includes an elastic sheet thrusting device arranged upstream of said first friction device and configured to thrust the stack of sheets stacked on said base plate to said second friction member, said second friction member being configured to provide the bottom sheet, of the stack of sheets stacked on said base plate and being thrust by the sheet thrusting device, with said second frictional resistance Fd.

21. The image forming apparatus of claim 16, wherein said sheet feeding device further comprises a base plate moving device configured to allow said base plate to move toward said feeding roller when said feeding roller feeds the uppermost sheet of the stack of sheets stacked on said base plate, such that the uppermost sheet of the stack of sheets contacts said feeding roller so as to be fed, said base plate moving device also being configured to allow said base plate to move away from said feeding roller when a sheet fed from said feeding roller is conveyed to a conveying member on a downstream side of said sheet feeding device.

22. The image forming apparatus of claim 16, wherein said base plate is inclined downwardly from said rear end of said base plate near said supporting axis is located toward said front end of said base plate which is adjacent to said feeding roller.

23. The image forming apparatus of claim 16, wherein a pulling force Fa of the feeding roller acts on the uppermost sheet of the stack of sheets stacked on the base plate, an inter-sheet frictional resistance Fb acts between the sheets of the stack of sheets stacked on said base plate, said first frictional resistance Fc is provided on the bottom sheet of the stack of sheets stacked on said base plate via said first friction member, said second frictional resistance Fd is provided on the bottom sheet of the stack of sheets stacked on said base plate via said second friction member, and a third frictional resistance Fe is provided on the bottom sheet of the stack of sheets stacked on said base plate via a portion of said upper surface of said base plate when any one of said first frictional resistance Fc provided by said first friction member and said second frictional resistance Fd provided by said second friction member is not provided on the bottom sheet of the stack of sheets stacked on said base plate so that a relationship of $Fa>(Fc+Fd+Fe)>Fb$ is satisfied.

24. The image forming apparatus of claim 23, wherein a relationship of $Fc>Fd$ is satisfied.

25. The image forming apparatus of claim 16, wherein said first frictional material of said first friction member is cork, and said second frictional material of said second friction member is resin.

26. The image forming apparatus of claim 16, wherein said first frictional material of said first friction member is resin and said second frictional material of said second friction member is cork.

27. The image forming apparatus of claim 16, wherein said first frictional material of said first friction member and said second frictional material of said second friction member are a same material which is cork.

28. The image forming apparatus of claim 16, wherein said first frictional material of said first friction member and said second frictional material of said second friction member are a same material which is resin.

29. A sheet feeding device comprising:

a feeding roller which is driven to rotate;

a base plate having an upper surface of a predetermined surface area upon which a stack of sheets is stacked, said base plate being configured to rotate around a supporting axis located near a rear end thereof in directions to contact and separate from said feeding roller located adjacent to a front end of said base plate, said upper surface of said base plate having a first part located adjacent to said front end thereof and a second part located adjacent to said rear end thereof, and said base plate being formed of a sheet metal material having relatively little frictional resistance;

a base plate pressing means for pressing said base plate so as to be rotated toward said feeding roller such that an uppermost sheet of the stack of sheets stacked on the base plate contacts said feeding roller in order to be fed by said feeding roller;

first friction means including a first friction member for providing a bottom sheet of the stack of sheets stacked on said base plate with a first frictional resistance Fc greater than a predetermined value, said first friction member being arranged in said first part of said upper surface of said base plate so as to be opposed to said feeding roller; and second friction means including a second friction member for providing the bottom sheet of the stack of sheets stacked on said base plate with a second frictional resistance Fd greater than the predetermined value, said second friction member being arranged upstream of said first friction member in a sheet feeding direction, said second friction member being made of a second frictional material which is different from said sheet metal material of said base plate.

30. An image forming apparatus comprising:

a sheet feeding device including:

a feeding roller which is driven to rotate:

a base plate having an upper surface of a predetermined surface area upon which a stack of sheets is stacked, said base plate being configured to rotate around a supporting axis located near a rear end thereof in directions to contact and separate from said feeding roller located adjacent to a front end of said base plate, said upper surface of said base plate having a first part located adjacent to said front end thereof and a second part located adjacent to a rear end thereof, and said base plate being formed of a sheet metal material having relatively little frictional resistance;

base plate pressing means for pressing said base plate so as to be rotated toward said feeding roller such that an upper most sheet of the stack of sheets stacked on said base plate contacts said feeding roller to be fed by said feeding roller;

first friction means including a first friction member for providing a bottom sheet of the stack of sheets stacked on said base plate with a first frictional resistance Fc greater than a predetermined value, said first friction member being arranged in said first part of said upper surface of said base plate so as to be opposed to said feeding roller, said first friction member being made of a first frictional material different from said sheet metal material of said base plate; and second friction means including a second friction member for providing the bottom sheet of the stack of sheets stacked on said base plate with a second frictional resistance Fd greater than the predetermined value, said second friction member being arranged upstream of said first friction member in a sheet feeding direction, said second friction member being made of a second frictional material which is different from said sheet metal material of said base plate;

sheet receiving/conveying means for receiving and conveying a sheet fed from said sheet feeding device; and image printing means for printing an image on the sheet fed from said sheet feeding device and conveyed by said sheet receiving/conveying means.

31. A method of feeding a stack of sheets stacked on a base plate to a sheet feeding device, said method comprising the steps of:

rotating a feeding roller;

pressing the base plate, formed of a sheet metal material having relatively little frictional resistance, toward the feeding roller so that an uppermost sheet of the stack of sheets stacked on the base plate contacts the feeding roller so as to be fed by the feeding roller; and providing a bottom sheet of the stack of sheets stacked on the base plate with a first frictional resistance from a first friction member of a first friction device of the sheet feeding device, the first friction member being located in a first part of an upper surface of the base plate at a position opposing the feeding roller, the first friction member being made of a first frictional material different from the sheet metal material of the base plate; and providing the bottom sheet of the stack of sheets stacked on the base plate with a second frictional resistance Fd from a second friction member of a second friction device of the sheet feeding device, the second friction member being located in a second part of the upper surface of the base plate, which is upstream of the first part of the upper surface of the base plate in a sheet feeding direction, the second friction member being made of a second frictional material which is different from the sheet metal material of the base plate.

32. The sheet feeding device of claim 31, wherein said step of providing the bottom sheet of the stack of sheets stacked on the base plate with the second frictional resistance Fd includes providing the second frictional resistance Fd on the bottom sheet via the second friction member of the second friction device, the second friction member being embedded in the second part of the upper surface of the base plate so that an upper surface of the second friction member is flush with the upper surface of the base plate and a rear end of the second friction member is slightly spaced from a rear end of the base plate, the upper surface of the second friction member having a relatively small surface area as compared with the surface area of the upper surface of the base plate.

33. The sheet feeding method of claim 31, wherein said step of providing the bottom sheet of the stack of sheets stacked on the base plate with the second frictional resistance Fd further includes providing a third frictional resistance Fe on the bottom sheet of the stack of sheets stacked on the base plate via a portion of the upper surface of the base plate when an elastic sheet thrusting device of the second friction device thrusts the stack of sheets stacked on the base plate towards the portion of the upper surface of the base plate.

34. The sheet feeding method of claim 33, further comprising providing the sheet thrusting device with a sheet member having elasticity.

35. The sheet feeding method of claim 31, wherein said step of providing the bottom sheet of the stack of sheets stacked on the base plate with the second frictional resistance Fd includes providing the second frictional resistance Fd via the second friction member of the second friction device, the second friction member being arranged on the second part of the upper surface of the base plate so that an elastic sheet thrusting device of the second friction device thrusts the stack of sheets stacked on the base plate towards the second friction member.

36. The sheet feeding method of claim 31, further comprising causing the base plate to retreat from the feeding roller when a fed sheet is conveyed to a conveying member in a downstream side of the sheet feeding device.

37. The sheet feeding method of claim 31, wherein said step of pressing the base plate toward the feeding roller includes positioning the base plate so as to be downwardly inclined from a rear end of the base plate on which a supporting axis is located toward a front end of the base plate located adjacent to the feeding roller.

38. The sheet feeding method of claim 31, further comprising:

providing a pulling force Fa of the feeding roller to act on the uppermost sheet of the stack of sheets stacked on the base plate;

providing an inter-sheet frictional resistance Fb to act between the stack of sheets stacked on the base plate;

providing the first frictional resistance Fc on the bottom sheet of the stack of sheets stacked on the base plate via the first friction member;

providing the second frictional resistance Fd on the bottom sheet of the stack of sheets stacked on the base plate via the second friction member; and providing a third frictional resistance Fe on the bottom sheet of the stack of sheets stacked on the base plate via a portion of the upper surface of the base plate when at least one of the first frictional resistance Fc provided by the first friction member and the second frictional resistance Fd provided by the second friction member is not provided on the bottom sheet so that a relationship of Fa>(Fc+Fd+Fe)>Fb is satisfied.

39. The sheet feeding method of claim 38, further comprising wherein a relationship of Fc>Fd is also satisfied.

40. The sheet feeding method of claim 31, further comprising preventing other sheets, besides the uppermost sheet of the stack of sheets stacked on the base plate, from being fed by the feeding roller.

41. A method of forming an image with an image forming apparatus, said method comprising the steps of:

rotating a feeding roller of a sheet feeding device of the image forming apparatus;

pressing a base plate of the sheet feeding device, which is made of a sheet metal material having relatively little frictional resistance and on which sheets are stacked to form a stack of sheets, toward the feeding roller so that an uppermost sheet of the stack of sheets stacked on the base plate contact the feeding roller so as to be fed by the feeding roller;

providing a bottom sheet of the stack of sheets stacked on the base plate with a first frictional resistance Fc via a first friction member of a first friction device of the sheet feeding device at a first part of an upper surface of the base plate, which opposes the feeding roller, the first friction member being made of a first frictional material different from the sheet metal material of the base plate;

providing the bottom sheet of the stack of sheets stacked on the base plate with a second frictional resistance Fd via a second friction member of a second friction device of the sheet feeding device at a second part of the upper surface of the base plate, which is upstream of the first part of the upper surface of the base plate in a sheet feeding direction, the second friction member being made of a second frictional material different from the sheet metal material of the base plate;

receiving and conveying a sheet fed from the sheet feeding device with a sheet receiving/conveying member of a printer of the image forming apparatus; and printing an image on the sheet fed from the sheet feeding device and conveyed by the sheet conveying member with the printer.

42. The image forming method of claim 41, wherein said step of providing the bottom sheet of the stack of sheets stacked on the base plate with the second frictional resistance Fd includes providing the second frictional resistance Fd via the second friction member, the second friction member being embedded in the second part of the upper surface of the base plate so that an upper surface of the second friction member is flush with the upper surface of the base plate and a rear end of the second friction member is slightly spaced from a rear end of the base plate, the upper surface of the second friction member having a relatively small surface area as compared with the surface area of the upper surface of the base plate.

43. The image forming method of claim 41, wherein said step of providing the bottom sheet of the stack of sheets stacked on the base plate with the second frictional resistance Fd includes providing the second frictional resistance Fd via the second part of the upper surface of the base plate when an elastic sheet thrusting device of the second friction device thrusts the stack of sheets stacked on the base plate towards the second part of the upper surface of the base plate.

44. The image forming method of claim 43, further comprising providing the sheet thrusting device with a sheet member having elasticity.

45. The image forming method of claim 41, wherein said step of providing the bottom sheet of the stack of sheets stacked on the base plate with the second frictional resistance Fd includes providing the second frictional resistance Fd via the second friction member of the second friction device, the second friction member being arranged on the second part of the upper surface of the base plate so that an elastic sheet thrusting device of the second friction device thrusts the stack of sheets stacked on the base plate towards the second friction member.

46. The image forming method of claim 41, further comprising causing the base plate to retreat from the feeding roller when a fed sheet is conveyed to a conveying member in a downstream side of the sheet feeding device.

47. The image forming method of claim 41, wherein said step of pressing said base plate toward the feeding roller includes downwardly inclining the base plate from a rear end of the base plate on which a supporting axis is located toward a front end of the base plate located adjacent to the feeding roller.

48. The image forming method of claim 41, further comprising:

providing a pulling force Fa of the feeding roller to act on the uppermost sheet of the stack of sheets stacked on the base plate;

providing an inter-sheet frictional resistance Fb to act between the stack of sheets stacked on the base plate;

providing the first frictional resistance Fc on the bottom sheet of the stack of sheets stacked on the base plate via the first friction member;

providing the second frictional resistance Fd on the bottom sheet of the stack of sheets stacked on the base plate via the second friction member;

providing a third frictional resistance Fe on the bottom sheet of the stack of sheets stacked on the base plate via a portion of the upper surface of the base plate when at least one of the first frictional resistance Fc provided by the first friction member and the second frictional resistance Fd provided by the second friction member is not provided on the bottom sheet so that a relationship of Fa>(Fc+Fd+Fe)>Fb is satisfied.

49. The image forming method of claim 41, further comprising wherein a relationship of Fc>Fd is also satisfied.

50. The image forming method of claim 41, further comprising preventing other sheets, besides the uppermost sheet of the stack of sheets stacked on the base plate, from being fed by the feeding roller.

51. A sheet feeding device comprising:

a feeding roller which is driven to rotate;

a base plate configured to stack sheets thereupon to form a stack of sheets, configured to move in directions to contact and separate from said feeding roller, and being made of a sheet metal material having little frictional resistance;

a base plate pressing member configured to press said base plate to be moved toward said feeding roller such that an uppermost sheet of the stack of sheets stacked on said base plate contacts said feeding roller so as to be fed by said feeding roller;

a first friction device including a first friction member arranged in a first part of an upper surface of said base plate so as to oppose said feeding roller, said first friction member being configured to provided a bottom sheet of the stack of sheets stacked on said base plate with a first frictional resistance Fc; and a second friction device including a second friction member arranged upstream of said first friction member in a sheet feeding direction, said second friction member being configured to provide the bottom sheet of the stack of sheets stacked on said base plate with a second frictional resistance Fd, said second friction member being made of either cork or resin and being embedded in said base plate so that an upper surface of said second friction member is flush with said upper surface of said base plate and a rear end of said second friction member is located a slight distance from a rear end of said base plate, said upper surface of said base plate having a relatively small surface area as compared to a surface area of said upper surface of said base plate.

52. An image forming apparatus comprising:

a sheet feeding device including:

a feeding roller which is driven to rotate;

a base plate configured to stack sheets thereupon to form a stack of sheets, configured to move in directions to contact and separate from said feeding roller, and being made of a sheet metal material having little frictional resistance;

a base plate pressing member configured to press said base plate to be moved toward said feeding roller such that an uppermost sheet of the stacked sheets on said base plate contacts said feeding roller so as to be fed by said feeding roller, a first friction device including a first friction member arranged in a first part of an upper surface of said base plate so as to oppose said feeding roller, said first friction member being configured to provided a bottom sheet of the stack of sheets stacked on said base plate with a first frictional resistance Fc; and a second friction device including a second friction member arranged upstream of said first friction member in a sheet feeding direction, said second friction member being configured to provide the bottom sheet of the stack of sheets stacked on said base plate with a second frictional resistance Fd, said second friction member being made of either cork or resin and being embedded in said base plate so that an upper surface of said second friction member is flush with said upper surface of said base plate and a rear end of said second friction member is located a slight distance from a rear end of said base plate, said upper surface of said second friction member having a relatively small surface area as compared to a surface area of said upper surface of said base plate;

a sheet receiving/conveying device configured to receive and convey a sheet fed from said sheet feeding device; and a printer configured to print an image on the sheet fed from said sheet feeding device and conveyed by said sheet receiving/conveying device.

53. A sheet feeding device comprising:

a feeding roller which is driven to rotate;

a base plate to stack sheets thereupon to form a stack of sheets, said base plate being configured to move in directions to contact and separate from said feeding roller, and said base plate being formed of a sheet metal material;

base plate pressing means for pressing said base plate to be moved toward said feeding roller such that an uppermost sheet of the stack of sheets stacked on said base plate contacts said feeding roller so as to be fed by said feeding roller;

first frictional resistance providing means for providing a bottom sheet of the stack of sheets stacked on said base plate with a first frictional resistance Fc, said first frictional resistance providing means being arranged in a vicinity of a first part of an upper surface of said base plate so as to oppose said feeding roller; and second frictional resistance providing means for providing the bottom sheet of the stack of sheets stacked on said base plate with a second frictional resistance Fd, said second frictional resistance providing means being arranged upstream of said first frictional resistance providing means in a sheet feeding direction, said second frictional resistance providing means being any one of cork or resin which is embedded in said base plate so that an upper surface of said second frictional resistance providing means is flush with said upper surface of said base plate and a rear end of said second frictional resistance providing means is located a slight distance from a rear end of said base plate, said upper surface of said second frictional resistance providing means having a relatively small surface area as compared to a surface area of said upper surface of said base plate.

54. An image forming apparatus comprising:

a sheet feeding device including:

a feeding roller which is driven to rotate;

a base plate to stack sheets thereupon to form a stack of sheets, and configured to move in directions to contact and separate from said feeding roller, said base plate being formed of a sheet metal;

base plate pressing means for pressing said base plate to be moved toward said feeding roller such that an uppermost sheet of the stack of sheets stacked on said base plate contacts said feeding roller so as to be fed by said feeding roller;

first frictional resistance providing means for providing a bottom sheet of the stack of sheets stacked on said base plate with a first frictional resistance Fc, said first frictional resistance providing means being arranged in a first part of an upper surface of said base plate so as to oppose said feeding roller, said first frictional resistance providing means being made of any one of cork or resin; and second frictional resistance providing means for providing the bottom sheet of the stack of sheets stacked on said base plate with a second frictional resistance Fd, said second frictional resistance providing means being arranged upstream of said first frictional resistance providing means in a sheet feeding direction, said second frictional resistance providing means being any one of cork or resin which is embedded in said base plate so that an upper surface of said second frictional resistance providing means is flush with said upper surface of said base plate and a rear end of said second frictional resistance providing means is located a slight distance from a rear end of said base plate, said upper surface of said second frictional resistance providing means having a relatively small surface area as compared to a surface area of said upper surface of said base plate;

sheet receiving/conveying means for receiving and conveying a sheet fed from said sheet feeding device; and image printing means for printing an image on the sheet fed from said sheet feeding device and conveyed by said sheet receiving/conveying means.

55. A sheet feeding device comprising:

a feeding roller which is driven to rotate;

a base plate having a stack of sheets stacked thereupon, said base plate being configured to rotate around a supporting axis thereof in directions to contact and separate from said feeding roller;

a base plate pressing member configured to press said base plate to be rotated toward said feeding roller such that an uppermost sheet of the stack of sheets stacked on said base plate contacts said feeding roller so as to be fed by said feeding roller;

a first friction device including a first friction member arranged in a first part of an upper surface of said base plate so as to oppose said feeding roller, said first friction member being configured to provide a bottom sheet of the stack of sheets stacked on said base plate with a first frictional resistance Fc greater than a predetermined value; and a second friction device including a second friction member arranged upstream of said first friction device in a sheet feeding direction, said second friction member being configured to provide the bottom sheet of the stack of sheets stacked on said base plate with a second frictional resistance Fd greater than the predetermined value, wherein a pulling force Fa of said feeding roller acts on the uppermost sheet of the stack of sheets stacked on said base plate, an inter-sheet frictional resistance Fb acts between sheets of the stack of sheets stacked on said base plate, said first frictional resistance Fc is provided on the bottom sheet of the stack of sheets stacked on said base plate via said first friction member, said second frictional resistance Fd is provided on the bottom sheet of the stack of sheets stacked on said base plate via said second friction member, and a third frictional resistance Fe is provided on the bottom sheet of the stack of sheets stacked on said base plate via a portion of said upper surface of said base plate when any one of said first frictional resistance Fc provided by the first friction member or said second frictional resistance Fd provided by said second friction member is not provided on the bottom sheet of the stack of sheets stacked on said base plate so that a relationship of $Fa>(Fc+Fd+Fe)>Fb$ is satisfied.

56. The sheet feeding device of claim 55, wherein a relationship of $Fc>Fd$ is satisfied.

57. A image forming apparatus comprising:

a sheet feeding device including:

a feeding roller which is driven to rotate;

a base plate having a stack of sheets stacked thereupon, said base plate being configured to rotate around a supporting axis thereof in directions to contact and separate from said feeding roller;

a base plate pressing member configured to press said base plate to be rotated toward said feeding roller such that an uppermost sheet of the stack of sheets stacked on said base plate contacts said feeding roller so as to be fed by said feeding roller;

a first friction device including a first friction member arranged in a first part of an upper surface of said base plate so as to oppose said feeding roller, said first friction member being configured to provide a bottom sheet of the stack of sheets stacked on said base plate with a first frictional resistance Fc greater than a predetermined value; and a second friction device including a second friction member arranged upstream of said first friction member in a sheet feeding direction and configured to provide the bottom sheet of the stack of sheets stacked on said base plate with a second frictional resistance Fd greater than the predetermined value;

a sheet receiving/conveying member configured to receive and convey a sheet fed from said sheet feeding device; and a printer configured to print an image on the sheet fed from said sheet feeding device and received and conveyed by said sheet receiving/conveying member, wherein a pulling force Fa of the feeding roller acts on the uppermost sheet of the stack of sheets stacked on the base plate, an inter-sheet frictional resistance Fb acts between the sheets of the stack of sheets stacked on said base plate, said first frictional resistance Fc is provided on the bottom sheet of the stack of sheets stacked on said base plate via said first friction member, said second frictional resistance Fd is provided on the bottom sheet of the stack of sheets stacked on said base plate via said second friction member, and a third frictional resistance Fe is provided on the bottom sheet of the stack of sheets stacked on said base plate via a portion of said upper surface of said base plate when any one of said first frictional resistance Fc provided by said first friction member and said second frictional resistance Fd provided by said second friction member is not provided on the bottom sheet of the stack of sheets stacked on said base plate so that a relationship of $Fa>(Fc+Fd+Fe)>Fb$ is satisfied.

58. The image forming apparatus of claim 57, wherein a relationship of $Fc>Fd$ is satisfied.

59. A method of feeding a stack of sheets stacked on a base plate to a sheet feeding device, said method comprising the steps of:

rotating a feeding roller;

pressing the base plate toward the feeding roller so that an uppermost sheet of the stack of sheets stacked on the base plate contacts the feeding roller so as to be fed by the feeding roller; and providing a bottom sheet of the stack of sheets stacked on the base plate with a first frictional resistance Fc from a first friction member of a first friction device of the sheet feeding device at a first part of an upper surface of the base plate so as to oppose the feeding roller;

providing the bottom sheet of the stack of sheets stacked on the base plate with a second frictional resistance Fd from a second friction member of a second friction device of the sheet feeding device at a second part of the upper surface of the base plate, the second part of the upper surface of the base plate being upstream of the first part of the upper surface of the base plate in a sheet feeding direction;

providing a pulling force Fa of the feeding roller which acts on the uppermost sheet of the stack of sheets stacked on the base plate;

providing an inter-sheet frictional resistance Fb which acts between the sheets of the stack of sheets stacked on the base plate;

providing the first frictional resistance Fc on the bottom sheet of the stack of sheets stacked on the base plate via the first friction member of the first friction device;

providing the second frictional resistance Fd on the bottom sheet of the stack of sheets stacked on the base plate via the second friction member of the second friction device;

providing a third frictional resistance Fe on the bottom sheet of the stack of sheets stacked on the base plate via a portion of the upper surface of the base plate when at least one of the first frictional resistance Fc provided by the first friction member of the first friction device and the second frictional resistance Fd provided by the second friction member of the second friction device is not provided on the bottom sheet so that a relationship of Fa>(Fc+Fd+Fe)>Fb is satisfied.

60. The sheet feeding method of claim 59, further comprising satisfying a relationship of Fc>Fd.

61. A method of forming an image with an image forming apparatus, said method comprising the steps of:

rotating a feeding roller of a sheet feeding device of the image forming apparatus;

pressing a base plate of the sheet feeding device, on which sheets are stacked to form a stack of sheets, toward the feeding roller so that an uppermost sheet of the stack of sheets stacked on the base plate contact the feeding roller so as to be fed by the feeding roller;

providing a bottom sheet of the stack of sheets stacked on the base plate with a first frictional resistance Fc via a first friction member of a first friction device of the sheet feeding device at a first part of an upper surface of the base plate so as to oppose the feeding roller;

providing the bottom sheet of the stack of sheets stacked on the base plate with a second frictional resistance Fd via a second friction member of a second friction device of the sheet feeding device at a second part of the upper surface of the base plate, the second part of the upper surface of the base plate being upstream of the first part of the upper surface of the base plate in a sheet feeding direction;

receiving and conveying a sheet fed from the sheet feeding device with a sheet receiving/conveying member of a printer of the image forming apparatus;

printing an image on the sheet fed from the sheet feeding device and received and conveyed by the sheet receiving/conveying member with the printer;

providing a pulling force Fa of the feeding roller which acts on the uppermost sheet of the stack of sheets stacked on the base plate;

providing an inter-sheet frictional resistance Fb which acts between the sheets of the stack of sheets stacked on the base plate;

providing the first frictional resistance Fc which acts on the bottom sheet of the stack of sheets stacked on the base plate via the first friction member of the first friction device;

providing the second frictional resistance Fd which acts on the bottom sheet of the stack of sheets stacked on the base plate via the second friction member of the second friction device;

providing a third frictional resistance Fe which acts on the bottom sheet of the stack of sheets stacked on the base plate via a portion of the upper surface of the base plate when at least one of the first frictional resistance Fc provided by the first friction member of the first friction device and the second frictional resistance Fd provided by the second friction member of the second friction device is not provided on the bottom sheet so that a relationship of Fa>(Fc+Fd+Fe)>Fb is satisfied.

62. The image forming method of claim 61, further comprising satisfying a relationship of Fc>Fd.

* * * * *